US006186876B1

(12) United States Patent
Christiansen

(10) Patent No.: US 6,186,876 B1
(45) Date of Patent: Feb. 13, 2001

(54) APPARATUS FOR GRINDING WELDING ELECTRODES, IN PARTICULAR WOLFRAM ELECTRODES

(76) Inventor: Jan Christiansen, Poulsvej 27, Praestbro, DK-9330 Dronninglund (DK)

( * ) Notice: Under 35 U.S.C. 154(b), the term of this patent shall be extended for 0 days.

(21) Appl. No.: 08/930,034

(22) PCT Filed: Dec. 27, 1995

(86) PCT No.: PCT/DK95/00519

§ 371 Date: Sep. 26, 1997

§ 102(e) Date: Sep. 26, 1997

(87) PCT Pub. No.: WO96/30162

PCT Pub. Date: Oct. 3, 1996

(30) Foreign Application Priority Data

Mar. 27, 1995 (DK) ..... 9500123

(51) Int. Cl.[7] ..... B24B 7/00

(52) U.S. Cl. ..... 451/278; 451/48; 451/282; 451/375; 451/382; 451/389

(58) Field of Search ..... 451/48, 278, 282, 451/375, 382, 389

(56) References Cited

U.S. PATENT DOCUMENTS 2,607,172 * 8/1952 Ruolle ..... 451/375
3,930,342 * 1/1976 Moores, Jr. et al. ..... 451/216
4,164,100 * 8/1979 Wolff ..... 451/410
4,541,760 * 9/1985 Zoueki ..... 409/137
5,400,546 * 3/1995 Christian et al. ..... 451/143

* cited by examiner

*Primary Examiner*—Timothy V. Eley
(74) *Attorney, Agent, or Firm*—Antonelli, Terry, Stout & Kraus, LLP

(57) ABSTRACT

The invention is a grinding apparatus for grinding tips of welding electrodes. An apparatus for grinding welding electrodes in accordance with the invention includes a drive motor for rotating a grinding disc and an electrode holder for fixing a welding electrode at an angle in relation to the grinding disc, the holder having a part which is displaceable vertically parallel to a plane of the grinding disc on a guide including first and second mutually displaced receivers for the electrode holder, the first receiver being positioned adjacent a scale provided on an outside of a housing which is used to set an angle at which a point of the electrode is to be ground with a radius of the scale being equal to a radius of the grinding disc and the second receiver fixing the electrode holder, which holds an electrode held therein having an end at which a point is to be ground by the grinding disc, parallel to the plane of the grinding disc with the point of the electrode engaging part of a periphery of the grinding disc with a vertical distance between the receivers being equal to a distance between the scale and the grinding disc.

20 Claims, 2 Drawing Sheets

APPARATUS FOR GRINDING WELDING ELECTRODES, IN PARTICULAR WOLFRAM ELECTRODES

BACKGROUND OF THE INVENTION

1. Field of the Invention

The present invention relates to an apparatus for grinding welding electrodes, in particular tungsten electrodes.

2. Description of the Prior Art

Known grinding apparatuses for grinding welding electrodes work with a rotating grinding disc, where the welding electrodes are pointed by pressing against a side surface of the grinding disc in a wanted angle. This grinding principle makes it complicated to vary the grinding angle or the point of the electrodes. Furthermore it is realized, that this grinding principle or grinding apparatus involve some unsolved environmental problems in connection with the aggressive grinding dust resulting from the grinding of welding electrodes containing tungsten.

SUMMARY OF THE INVENTION

The invention has for its purpose to provide an improved apparatus for grinding of welding electrodes, and which by means of simple provisions makes it easier to adjust the grinding angle; as the apparatus in a preferred embodiment may satisfy environmental problems in connection with for instance grinding of tungsten electrodes.

The apparatus according to the invention is distinctive in that afixing comprising an apparatus part arranged to be displaceable parallel to the plane of the grinding disc on a fixed guiding extending vertically, which apparatus part comprises two mutually displaced insertion openings or insertion positions for an electrode holder, namely a first insertion opening or position in front of an arched angle scale provided on the external side of a housing the radius of the arched angle scale is equal to that of the grinding disc) and a second insertion opening or position situated and adapted to fix the electrode parallel to the plane of the grinding disc with the point engaging the upper part of the periphery of the grinding disc (the vertical distance) between the insertion openings is equal to that between the arched angle scale and the grinding disc). By means of simple provisions a grinding apparatus is hereby obtained, which makes it easier to adjust the wanted grinding angle.

Appropriately the apparatus according to the invention is furthermore such provided, that the grinding disc is arranged in a grinding housing preferably built together with a drive motor, the housing being closed with a preferably transparent wall part, and being adapted to be filled with a grinding fluid, preferably water. In a simple manner the the environmental problems with aggressive grinding dust are hereby met, by which manner for an effective collecting of the grinding dust containing tungsten and having a considerable reusable value, furthermore is obtained.

In order to minimize the spraying from the rotating grinding disc, of which the lowermost part is surrounded by the grinding water, the apparatus may advantageously be such provided, that the grinding housing downwards has larger width, and that the grinding housing in front of the grinding disc comprises an(from the bottom) upright partition wall, which lowermost is provided with one or more flow through openings. Due to the rotation of the grinding disc the main part of the grinding fluid is forced out through said flow through openings, so that the fluid level under the grinding disc is minimized.

Also to keep the grinding fluid effectively inside, the apparatus according to the invention may be such provided, that the displaceable apparatus part preferably is waterproof connected with the grinding housing, as there in a side wall part of the grinding housing in front of the active insertion opening or the active insertion position for the electrode holder a flexible, oblong lip tighting is arranged, through which the outermost end of the electrode holder may be inserted.

BRIEF DESCRIPTION OF THE DRAWING

The invention is explained in more detail in the following with reference to the drawing, in which.

Figure 1:
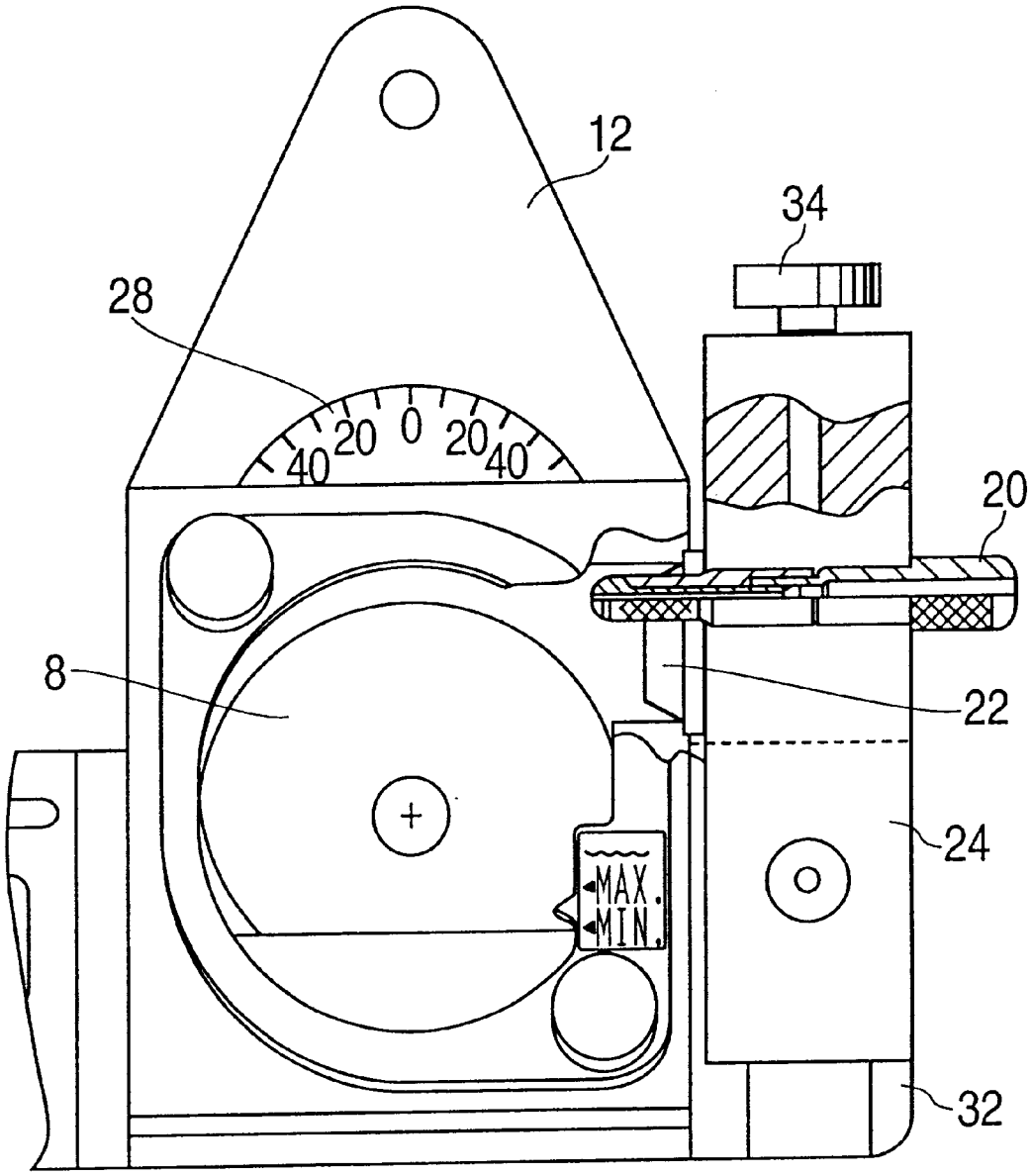
FIG. 1 shows a view—partly in section—of a preferred embodiment for a grinding apparatus according to the invention—seen from the front.

The shown grinding apparatus 2 is provided as a transportable unit with an electric motor 4, a closed grinding housing 6 with a rotating, relatively thin grinding disc 8. The grinding housing 6 is built together with an upper handle 10, which from a mainly triangular gable plate 12 projects over the electric motor 4, that is that the balance of the grinding apparatus 2 is optimum.

As most clearly shown in FIG. 2 the grinding house 6 has a mainly triangular cross section with most width below. The grinding housing 6 is closed outwardly by means of a clear acrylic plate 14, which makes it possible to watch the fluid level, as water is filled in the grinding housing 6, so that the grinding disc is kept wet during the grinding process, and so that the grinding dust is collected in the grinding fluid. In the bottom of the grinding housing 6 a partition wall 16 with lower flow through openings 18 is placed in front of the grinding disc 8. The partition wall 16 has the primary function—during the rotation of the grinding disc —to keep most of the grinding fluid away from the grinding disc 8 to limit the spraying from the rotating grinding disc 8. When the grinding disc 8 stands still the fluid level of course is equal on both sides of the partition wall 16; but when the grinding disc 8 rotates, most of the grinding fluid is forced to the front of the partition wall 16, that is that the fling off of the grinding fluid is minimized.

During the grinding work the welding electrode to be grinded is fixed in a n electrode holder 20, which for the fixing of the welding electrode is provided with holding device using the same holding principle as that of a drilling cartridge or of a press pencil. The front end of the electrode holder 20 is inserted in the grinding housing 6 through tightening device 22 in a side wall part 2 1, so that the electrode point itself may be pressed tangentially against the periphery of the grinding disc, that is that the tightening device 22 in the height is stretching over the whole adjustment area of the electrode holder.

In other words the electrode point according to the invention is grinded by pressing against the periphery of the grinding disc 8, and the adjustment of a wanted point angle is obtained by the fact that the engaging area between the electrode, when it is placed in the first insertion opening 26, and the grinding disc 8, is moved along the upper part of the periphery of the angle scale 28 to the wanted angle position. This is obtained by displacing the displaceable apparatus part in a fixed guiding in a direction parallel with the plane of the grinding disc, and by situating and adapting the second insertion opening 30, such that the electrode is fixed parallel with the plane of the grinding disc 8 for engaging the electrode point against the upper part of the periphery of the grinding disc 8.

Figure 2:
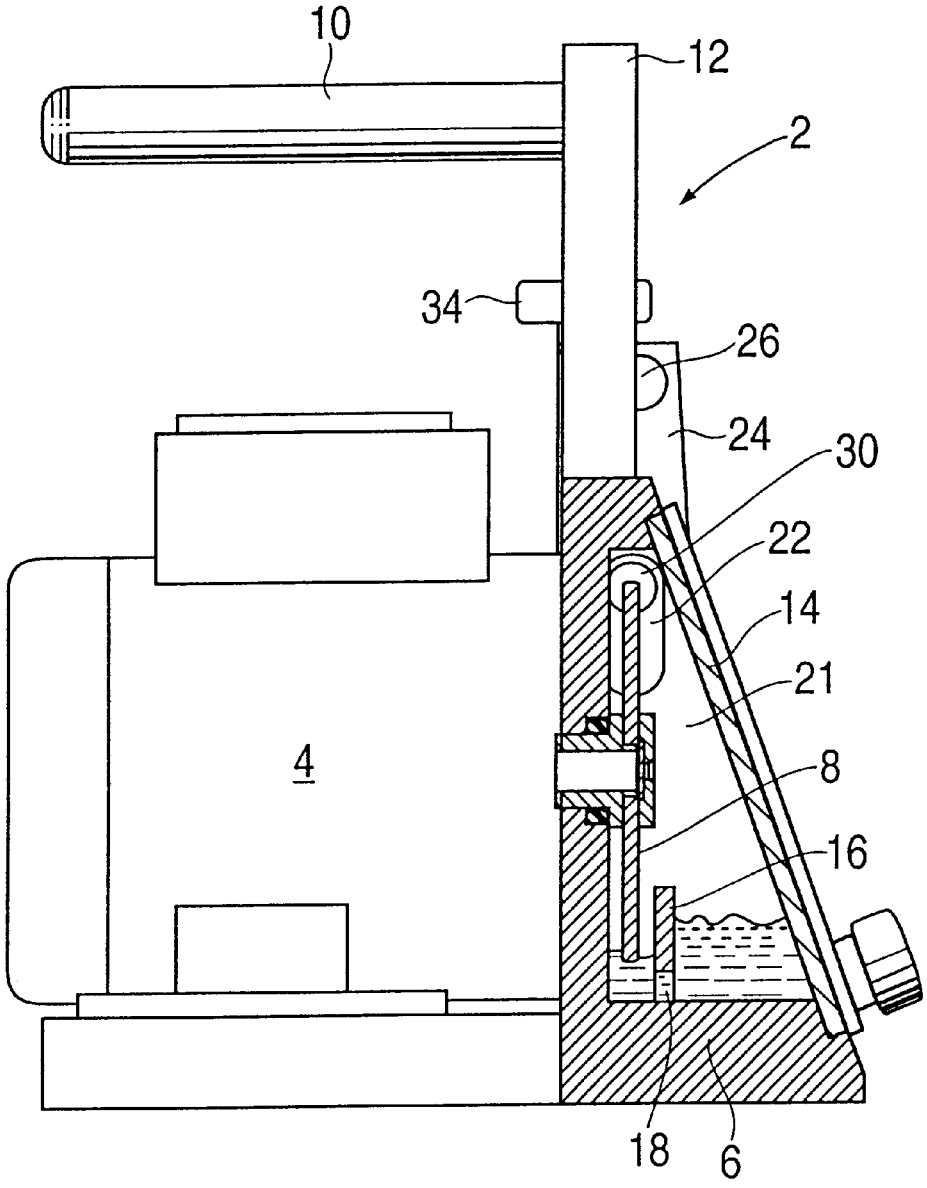
FIG. 2 shows a side sectional view of the grinding apparatus shown in FIG. 1.

The grinding apparatus 2 is at the right handside of FIG. Cl provided with a height displaceable sliding bracket 24, which cf. FIG. 2 has two mutual fixed insertion positions or openings for the electrode holder 20, namely an upper, first insertion opening 26 for insertion of the electrode holder 20 in order to adjust the point angle of the welding electrode in relation to the angle scale 28 on the front of the grinding housing 6, and a lowermost, second insertion opening 30 positioned on level with the wanted angle position of the periphery of the grinding disc, as the sliding bracket 24 may be adjusted in relation to the fixed guiding 32 by means of a finger screw 34.

What is claimed is:

1. An apparatus for grinding welding electrodes comprising:

a drive motor for rotating a grinding disc and an electrode holder for fixing a welding electrode at an angle in relation to the grinding disc, the holder having a part which is displaceable vertically parallel to a plane of the grinding disc on a guide including first and second mutually displaced receivers for the electrode holder, the first receiver being positioned adjacent a scale provided on an outside of a grinding housing which is used to set an angle at which an end of the electrode is to be ground into a point with a radius of the scale being equal to a radius of the grinding disc and the second receiver fixing the electrode holder which holds an electrode held therein having the end at which the point is to be ground by the grinding disc parallel to the plane of the grinding disc with the point of the electrode engaging part of a periphery of the grinding disc with a vertical distance between the receivers being equal to a distance between the scale and the grinding disc.

2. An apparatus in accordance with claim 1, wherein:

the grinding disc is positioned in the grinding housing, the grinding housing being closed with a wall and containing a grinding fluid during grinding.

3. An apparatus in accordance with claim 2 wherein:

a shaft of the drive motor is connected to the grinding disc and extends from outside the grinding housing to the grinding disc.

4. An apparatus in accordance with claim 3 wherein:

the grinding housing comprises a transparent wall which makes visible the grinding disc from outside the grinding housing.

5. An apparatus in accordance with claim 4 wherein:

the grinding fluid which is contained in the grinding housing is water.

6. An apparatus in accordance with claim 5 wherein:

the grinding housing at a base thereof is wider than at a top of the grinding housing and comprises in front of the grinding disc an upright partition wall which at a lowermost part is provided with at least one flow through opening.

7. An apparatus in accordance with claim 6, wherein:

the holder is connected to the grinding housing, a side wall part of the grinding housing is disposed in front of the second receiver of the electrode holder, and an outermost end of the electrode is insertable through a tightening device.

8. An apparatus in accordance with claim 5, wherein:

the holder is connected to the grinding housing, a side wall part of the grinding housing is disposed in front of the second receiver of the electrode holder, and an outermost end of the electrode is insertable through a tightening device.

9. An apparatus in accordance with claim 4 wherein:

the grinding housing at a base thereof is wider than at a top of the grinding housing and comprises in front of the grinding disc an upright partition wall which at a lowermost part is provided with at least one flow through opening.

10. An apparatus in accordance with claim 9, wherein:

the holder is connected to the grinding housing, a side wall part of the grinding housing is disposed in front of the second receiver of the electrode holder, and an outermost end of the electrode is insertable through a tightening device.

11. An apparatus in accordance with claim 4, wherein:

the holder is connected to the grinding housing, a side wall part of the grinding housing is disposed in front of the second receiver of the electrode holder, and an outermost end of the electrode is insertable through a tightening device.

12. An apparatus in accordance with claim 3 wherein:

the grinding housing at a base thereof is wider than at a top of the grinding housing and comprises in front of the grinding disc an upright partition wall which at a lowermost part is provided with at least one flow through opening.

13. An apparatus in accordance with claim 12, wherein:

the holder is connected to the grinding housing, a side wall part of the grinding housing is disposed in front of the second receiver of the electrode holder, and an outermost end of the electrode is insertable through a tightening device.

14. An apparatus in accordance with claim 3, wherein:

the holder is connected to the grinding housing, a side wall part of the grinding housing is disposed in front of the second receiver of the electrode holder, and an outermost end of the electrode is insertable through a tightening device.

15. An apparatus in accordance with claim 2 wherein:

the grinding housing at a base thereof is wider than at a top of the grinding housing and comprises in front of the grinding disc an upright partition wall which at a lowermost part is provided with at least one flow through opening.

16. An apparatus in accordance with claim 15, wherein:

the holder is connected to the grinding housing, a side wall part of the grinding housing is disposed in front of the second receiver of the electrode holder, and an outermost end of the electrode is insertable through a tightening device.

17. An apparatus in accordance with claim 2, wherein:

the holder is connected to the grinding housing, a side wall part of the grinding housing is disposed in front of the second receiver of the electrode holder, and an outermost end of the electrode is insertable through a tightening device.

18. An apparatus in accordance with claim 1 wherein:

the grinding housing at a base thereof is wider than at a top of the grinding housing and comprises in front of the grinding disc an upright partition wall which at a lowermost part is provided with at least one flow through opening.

19. An apparatus in accordance with claim 18, wherein:

the holder is connected to the grinding housing, a side wall part of the grinding housing is disposed in front of the second receiver of the electrode holder, and an outermost end of the electrode is insertable through a tightening device.

20. An apparatus in accordance with claim 1, wherein:

the holder is connected with the grinding house, a side wall part of the grinding housing is disposed in front of the second receiver of the electrode holder, and an outermost end of the electrode is insertable through a flexible oblong lip tightening.

* * * * *